US006612298B2

(12) United States Patent
Mendoza-Orozco

(10) Patent No.: US 6,612,298 B2
(45) Date of Patent: Sep. 2, 2003

(54) SAFETY FOR SPORTING PELLET OR AIR GUNS

(76) Inventor: Hector Mendoza-Orozco, Prolongación Constitción No. 57, Colonia Santiago Tepalcatlalpan, 16210 Xochimilco Distrito Federal (MX)

( * ) Notice: Subject to any disclaimer, the term of this patent is extended or adjusted under 35 U.S.C. 154(b) by 0 days.

(21) Appl. No.: 10/041,991

(22) Filed: Jan. 9, 2002

(65) Prior Publication Data

US 2003/0010331 A1 Jan. 16, 2003

(30) Foreign Application Priority Data

Jul. 13, 2001 (MX) ..... 01007171

(51) Int. Cl.[7] ..... F41A 19/06; F41A 19/00; F41A 17/62

(52) U.S. Cl. ..... 124/37; 124/40; 124/66

(58) Field of Search ..... 124/37, 40, 65, 124/66

(56) References Cited

U.S. PATENT DOCUMENTS 1,164,646 A * 12/1915 Heyman ..... 124/66
1,509,257 A * 9/1924 Randall ..... 124/67
2,729,208 A * 1/1956 Gaeke ..... 124/66
2,837,865 A * 6/1958 Wells ..... 446/192
3,465,741 A * 9/1969 Daliel et al. ..... 124/55
3,839,999 A * 10/1974 Fleming et al. ..... 124/66
5,596,976 A * 1/1997 Waiser ..... 124/25
5,666,753 A * 9/1997 Kolling ..... 42/70.01
5,941,005 A * 8/1999 Battaglia et al. ..... 42/70.08
6,223,460 B1 * 5/2001 Schmitter et al. ..... 42/70.06
6,352,070 B1 * 3/2002 Mendoza-Orozco ..... 124/37

* cited by examiner

*Primary Examiner*—Charles T. Jordan
*Assistant Examiner*—Stephen A. Holzen
(74) *Attorney, Agent, or Firm*—Harrison & Egbert

(57) ABSTRACT

A new safety that is incorporated to a sporting pellet or air gun by which the accidental firing of the gun is prevented even when the gun is loaded, making it necessary to remove it in order to fire the gun. This safety includes a square bulky button with cut edges at the top that make it look like a trapezium in its cross-section view; and grooves on the surface to hold and move it manually, and that on its lower face is curved having the correlative shape of the barrel, and also has a side bore where a peg that joins the base of the safety is introduced. A base of the safety, placed under the safety that is a rectangular piece acts as a cam to place the latch when the gun is loaded, from which a second piece also rectangular in shape sticks out. This has a side bore towards the top correlative to the bore in the latch, and this top peg also has a top cut and a spring that consists of a level live plate with an oval central bore, correlative to the peg in the latch so that it can be introduced by means of a flexion movement and that presses the latch keeping it pressed and fixed.

1 Claim, 7 Drawing Sheets

SAFETY FOR SPORTING PELLET OR AIR GUNS

BACKGROUND OF THE INVENTION

1. Field of the Invention

This invention refers to a new safety that has been greatly improved and that is incorporated towards the end of the mechanism chamber of the gun where the sight is generally placed. This safety moves forward and returns to its original position and includes several means that lock it within an eyelet on the barrel of the gun making it necessary to unlock the safety manually in order to fire the gun, because the device is locked automatically when it is loaded.

These kinds of guns are used as a fun and sport article mainly by young boys and teenagers. Used as such, this invention contributes to preventing any possible accident caused by an unsuitable use of the gun or by trying to operate it inappropriately. Consequently, the scope for the use of this invention is within the universe of sporting pellet or air guns.

2. Description of Related Art

Several patents include the development of different types of gun devices; for example, the American Patents U.S. Pat. Nos. 1,164,646, 1,509,257, 2,729,28, 3,465,741, and 3,839,999.

As it is widely known, there are many kinds of safeties for guns that have been referred to in several patents, among which the American Patents U.S. Pat. No. 1,164,646, 1,509,257, 2,729,28, 3,465,741, and 3,839,999 should be mentioned.

1. U.S. Pat. No. 1,164,646 (Pop gun—Heyman and Arden) dated Dec. 21, 1915 mentions a shooting mechanism for a sporting cork gun for children. The mechanism that is being proposed is different from that patent because, in the above mentioned patent the gun is not locked while the invention herein includes a latch that is automatically locked when the gun is loaded.

2. U.S. Pat. No. 1,509,257 (Air Gun or Gun—Randall) dated Feb. 26, 1926 lays claim to a spring mechanism for air guns. Although such invention preceded this proposal, it does not include a safety mechanism to prevent an accidental shot; in addition, it does not have any kind of mechanism that prevents a shot when the cam is not in place, such being the case, the cam might trap the fingers when the gun is shot.

3. U.S. Pat. No. 2,729,208 (Popgun—Gaeke) dated Sep. 11, 1953 protects an air blast gun whose mechanism produces a sound similar to that of a real gun. On the other hand, the cam blocks the shooting mechanism but not the trigger directly.

4. U.S. Pat. No. 2, 837,837,865 (Popgun construction—Wells) dated Jun. 10, 1958 lays claim to a mechanism that consists of a valve through which a blast for toy popguns is produced.

5. U.S. Pat. No. 3,465,741 (Popgun with extended barrel for protecting puff of air—Daniel et al) dated Jun. 15, 1965 refers to a mechanism that produces a blast for an air gun by means of a valve. Therefore, this invention is very different from the proposal, and even though the same or similar means might exist, the arrangement of such is totally different.

6. U.S. Pat. No. 3,839,999 (Gun with safety member mounted therein—Fleming) protects a side latch activated by several strength cams. The invention proposed is different due to the fact that it refers to a button that works directly without any cams.

The last invention which has an auxiliary safety not included, the others have none to protect the gun when loaded.

It has also been observed that in some cases lack of knowledge of the mechanism of the gun has caused some minor injuries on the users, especially on their hands and fingers. This is due to excessive confidence and to trying to discover what might happen when the gun is in a different position to that which is considered normal.

Talking specifically about the sporting pellet gun with a reloading cam below the trigger, it can be said that there has been no improvement to date, and that it has only undergone slight modifications as regards its internal mechanism.

Consequently, in accordance with this background and to the best of my knowledge, there is no close invention to that being proposed, thus the implemented improvements originate a new invention.

BRIEF SUMMARY OF THE INVENTION

The main objective of this invention is to prevent the user from having an accident should the safety be moved inadvertently when the gun is already loaded and ready for shooting.

Another objective of this invention is to have an external safety for the sporting pellet gun with safety mechanisms that prevent it from being unlocked inadvertently and thus minimize accidents caused by wrong handling or lack of knowledge.

The third objective of this invention is to avoid the safety from being unlocked even if the gun is dropped and it lands on the safety itself.

This external safety fully complies with all the regulations and safety standards set by the authorities in Mexico as well as by foreign authorities, mainly in the United States.

BRIEF DESCRIPTION OF THE SEVERAL VIEWS OF THE DRAWINGS

The characteristics of this safety for sporting pellet guns are clearly shown in the description that follows and in the attached drawings that illustrate such description. The same reference signs represent the same parts in the drawings.

FIG. 12 highlights the initial operations; FIG. 13, the loading action with the movement of the piston; and FIG. 14, loading completion with the total movement of the piston and the placement of the trigger safety.

DETAILED DESCRIPTION OF THE INVENTION

Figure 1:
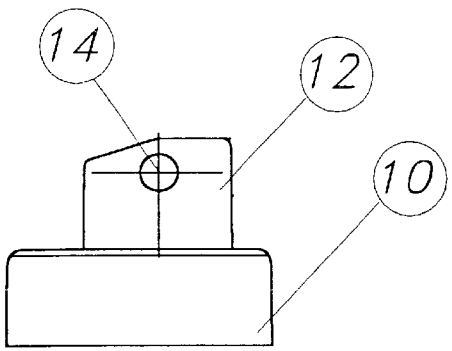
FIG. 1 is a side view of the safety base of the gun.
Figure 2:
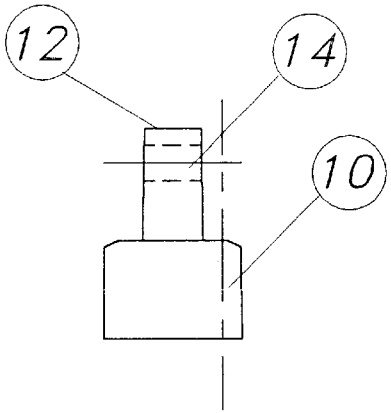
FIG. 2 is a front view of the safety base of the gun.
Figure 3:
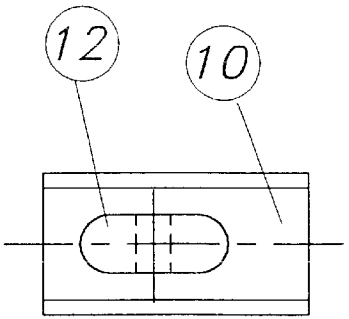
FIG. 3 is a top view of the safety base of the gun.
Figure 4:
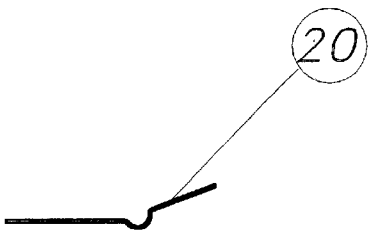
FIG. 4 is an isolated schematic view of the spring.
Figure 5:
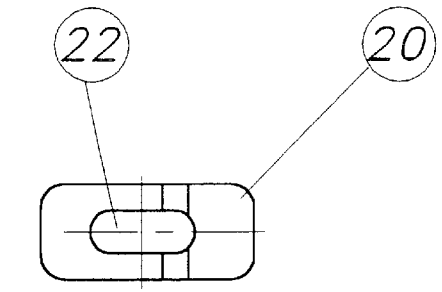
FIG. 5 is also a side view of the safety spring of the gun.
Figure 7:
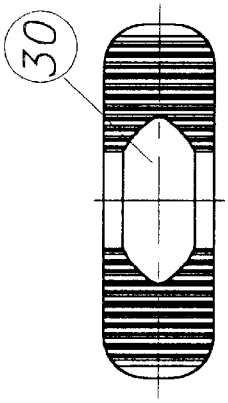
FIGS. 6 to 10 are a cross-section view, a top view, a side view, a front view, and a conventional perspective view of the safety of the gun.
Figure 10:
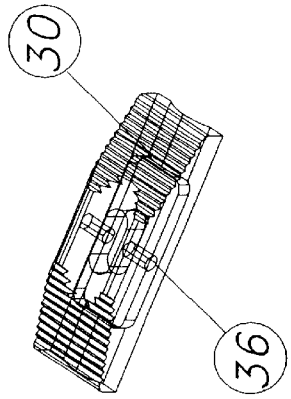
Figure 6:
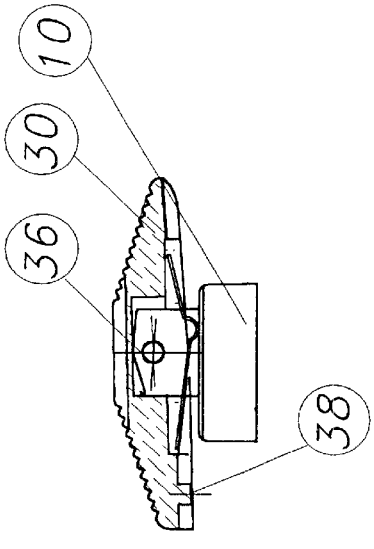
Figure 9:
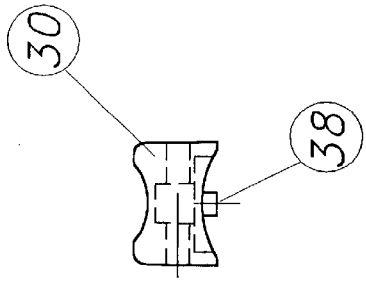
Figure 8:
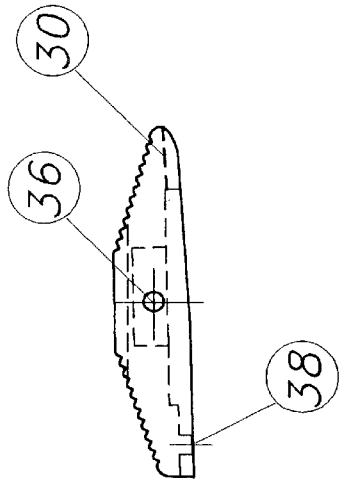

This invention refers to a safety for a sporting air or pellet gun by which a safe operation of such is guaranteed avoiding accidents caused by an inappropriate use of the gun when handled by young boys and teenagers.

Referring to the above mentioned figures, the gun with a safety herein consists of a barrel 70 at the front through which the bullet or pellet will be shot, followed by a mechanism chamber where the firing mechanism is located, and by the buff that is used as support when firing.

Towards the end of the mechanism chamber, where it joins the butt, there is a safety 30 at the top that is leaned forwards and has a rocking movement and that consists of a square bulky button with cut edges at the top that make it look like a trapezium in its cross-section view; it has grooves on the surface to hold and move it manually; and it also has a small chamber where the spring 20 is placed, there is also a side bore 36 through which a safety which is attached to a latch 10 is introduced, and that together with the safety 30 prevents the gun from being fired even when it has been already loaded. This safety 30 has a peg 38 that consists of a slightly longer vertical straight shaft so that it juts out; this peg 38 will go into an eyelet where the safety 30 runs, placed externally on the side where the sight is generally located and the safety 30, moves forward releasing the peg 38 from the eyelet and returning it to its initial position.

Under the safety 30, its base 10 is located; this consists of a rectangular shaped piece that acts as a cam to lock the safety 30 when loading the gun; from the base of the latch 10 a second slightly smaller rectangular piece 12 with an oval base sticks out, this is the upper peg 12 that has a side bore towards the top placed correlatively to the bore 36 on the safety 30, and this upper peg 12 features an upper cut 14 that allows the safety 30 to run forwards with a tilted movement and thus place the peg 38 in the eyelet, making it necessary to press the safety 30 lightly so that it moves forwards.

A spring 20 that consists of a live sheet with an oval central bore correlative to the peg in the safety 30, so that it can be placed within the safety chamber; the spring slightly bent on one of its ends in order to have movement presses the safety, tilts it forward and allows a rocking movement, thus it is necessary to press the safety 30 at the rear end to release the peg 38 from the eyelet or track on the mechanism chamber in order to move forwards.

Towards the middle of the mechanism chamber, there is an elongated cocking cam 72 that towards the rear has an eyelet 74. This cocking cam 72 is then placed on a groove at the bottom of the butt in a resting position, this acts as a grabbing point to start the cocking operation of the gun. The cocking cam 72 is supported by an axial bolt 76 by which the cocking cam 72 is rotated. This cam also has a second eyelet 78 below the trigger 40 arranged in such a way as to allow the finger in to fire a shot. Above the axial bolt 76 there is a crescent shaped means, part of the cam 72 itself, that is arranged in such a way that when the cam 72 is rotated for cocking, covers the trigger 40, thus preventing the undue placement of the finger when cocking, and even in the event the gun is loaded, does not allow a shot to be fired because the cocking cam is placed in an open position or in such a position that is not the actual resting position. Lastly, the cocking cam 72 is thrust towards the end by means of a pusher 82 having the shape of a hook that acts as guide and drive of the piston 60. It also has a small spring retaining cam towards the rear that rests over a pawl 84 that consists of a bolt placed inside the barrel 70 that locks and secures the cocking cam 72.

A piston 60, located inside the barrel 70, cylindrical in shape with an internal groove (not shown), along which the pusher 82 moves and rotates; a spring 62 coils the stem of the piston 60 and such spring is compressed when the gun is prepared for shooting, this corresponds to the backward position of the piston 60. The end of the piston 60 that is not shown in the drawing has a gasket (not shown either), while at the other end there is a rectangular plate 64 called piston retaining plate that pushes a retention cam 50 as well as the base of a piston 60 along the guide of the pusher 82.

The trigger 40 is formed by a channel shaped plate, with a slightly curved elongated portion that forms the trigger itself where the finger is placed in order to fire the gun. This trigger, shaped as an L, projects towards the inside of the gun and is locked by means of a pusher 42 that is followed by a second elongated portion whose ends form the support legs 44 of the safety. So, once the gun has been loaded, the safety 30 operates automatically, the support legs 44 are then under the base of the safety 30, therefore, the trigger cannot be operated and consequently the gun cannot be shot.

The retention cam 50 consisting of a U shaped plate, with a bore at one end, is placed inside the channel of the barrel 70, and is locked by means of the pusher 42. At the other end of the cam there is a spring 52 that moves the cam in such a way that one of the ends is not covered so that when it touches the plate or stopper of the piston 60, this moves downwards to then return and secure the stem of the piston 60 as if it were the bolt in a lock.

In order to clarify the operation of the mechanism described above, a series of drawings with the corresponding numbers are included.

Figure 11:
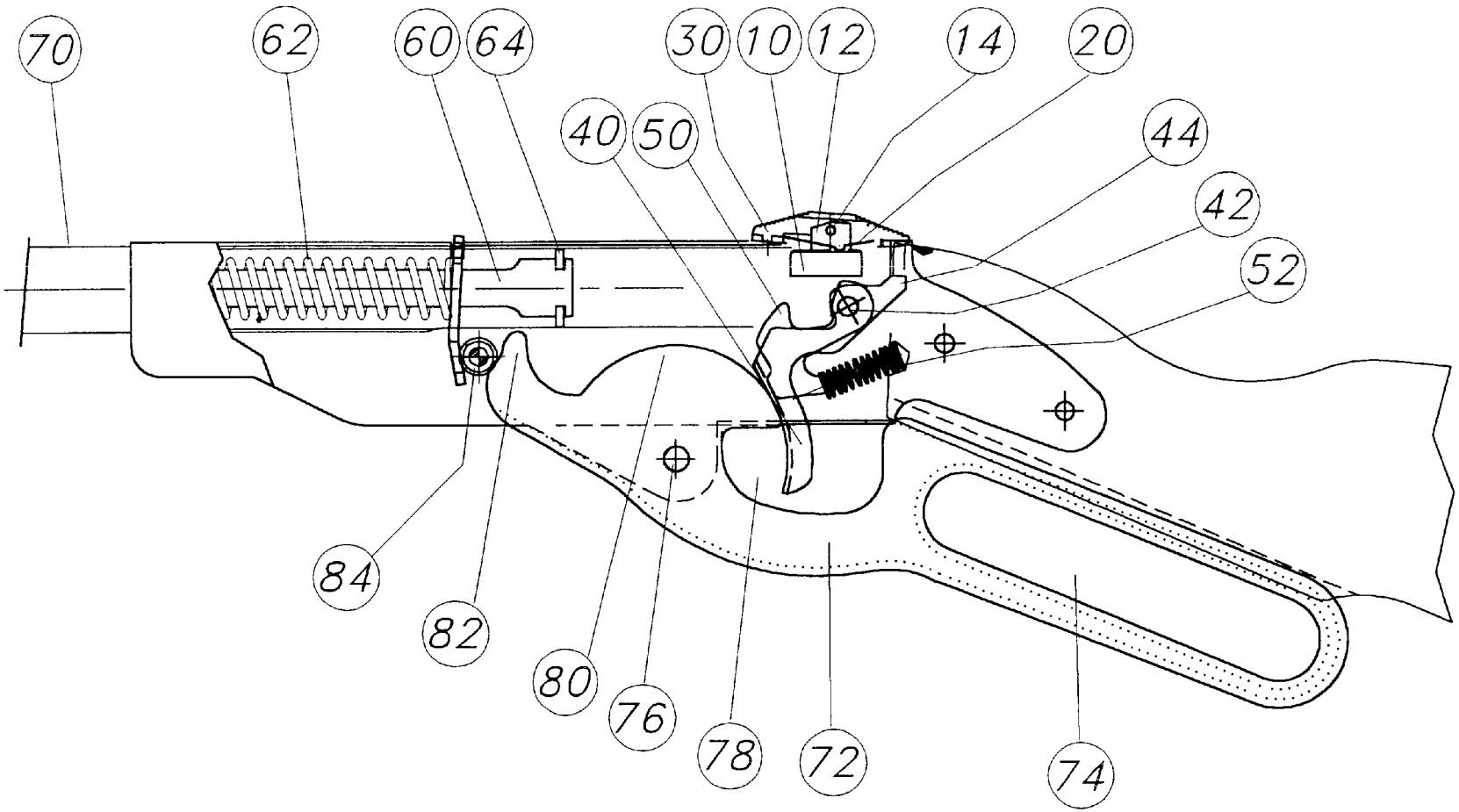
FIG. 11 is a cross-section of the mechanism of the sporting gun in an unloaded position that shows the position of the safety of the gun.
Figure 12:
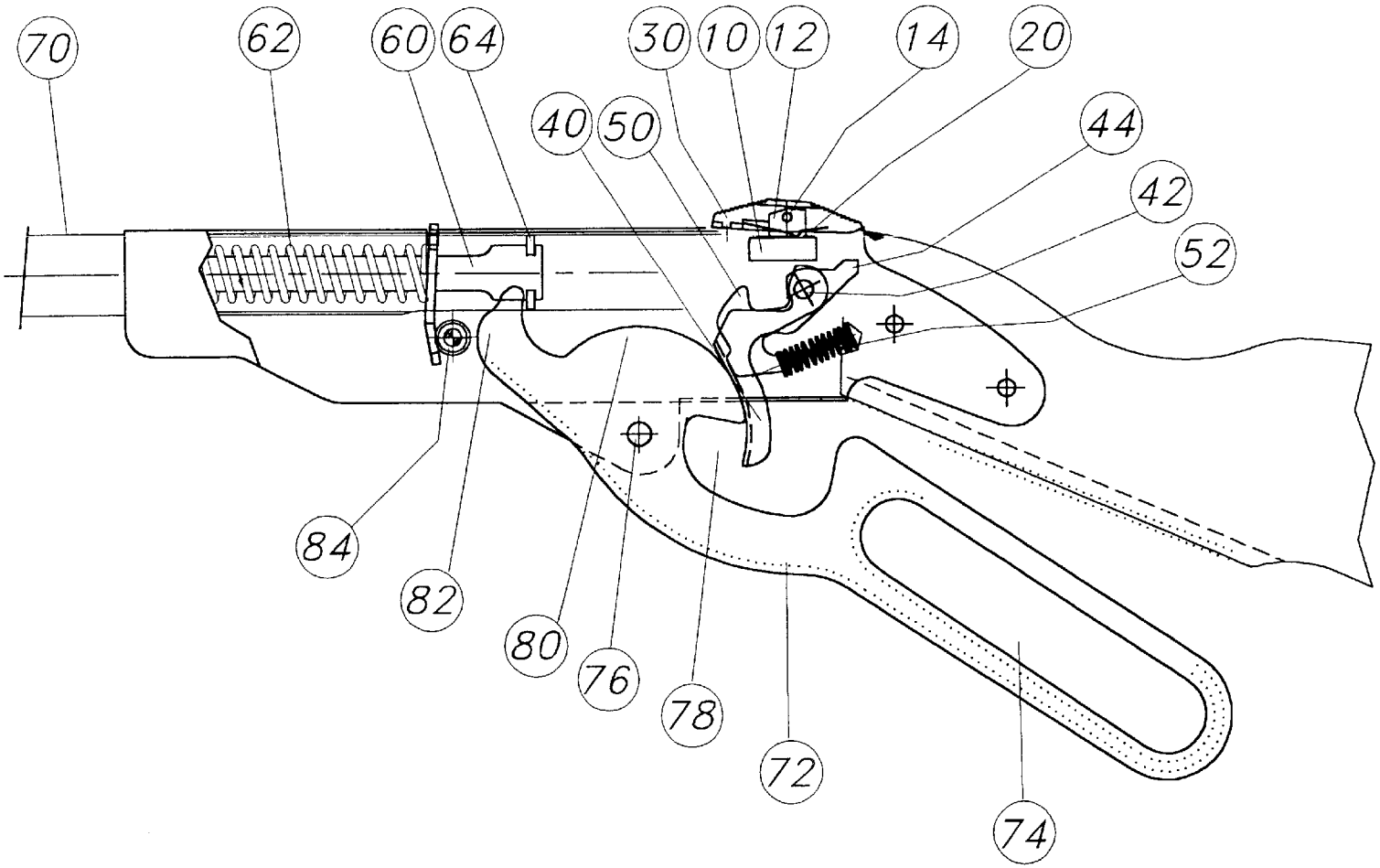
FIGS. 12, 13 and 14 are cross-sectional views showing a sequence of the movement of the loading cam.

Let us consider that the gun is unloaded (FIG. 11). The piston is located towards the front and all the other pieces are at rest.

The beginning of the loading process starts by articulating the loading cam 72 so that the pusher 82 is introduced through the piston groove (not shown) placing the tip of the pusher over the plate 64 or stopper of the piston 60. The spring 62 that covers the piston begins to contract. At the same time, the crescent piece 80 of the loading cam 72 stands in the way of the trigger 40 not allowing the introduction of a finger.

Figure 13:
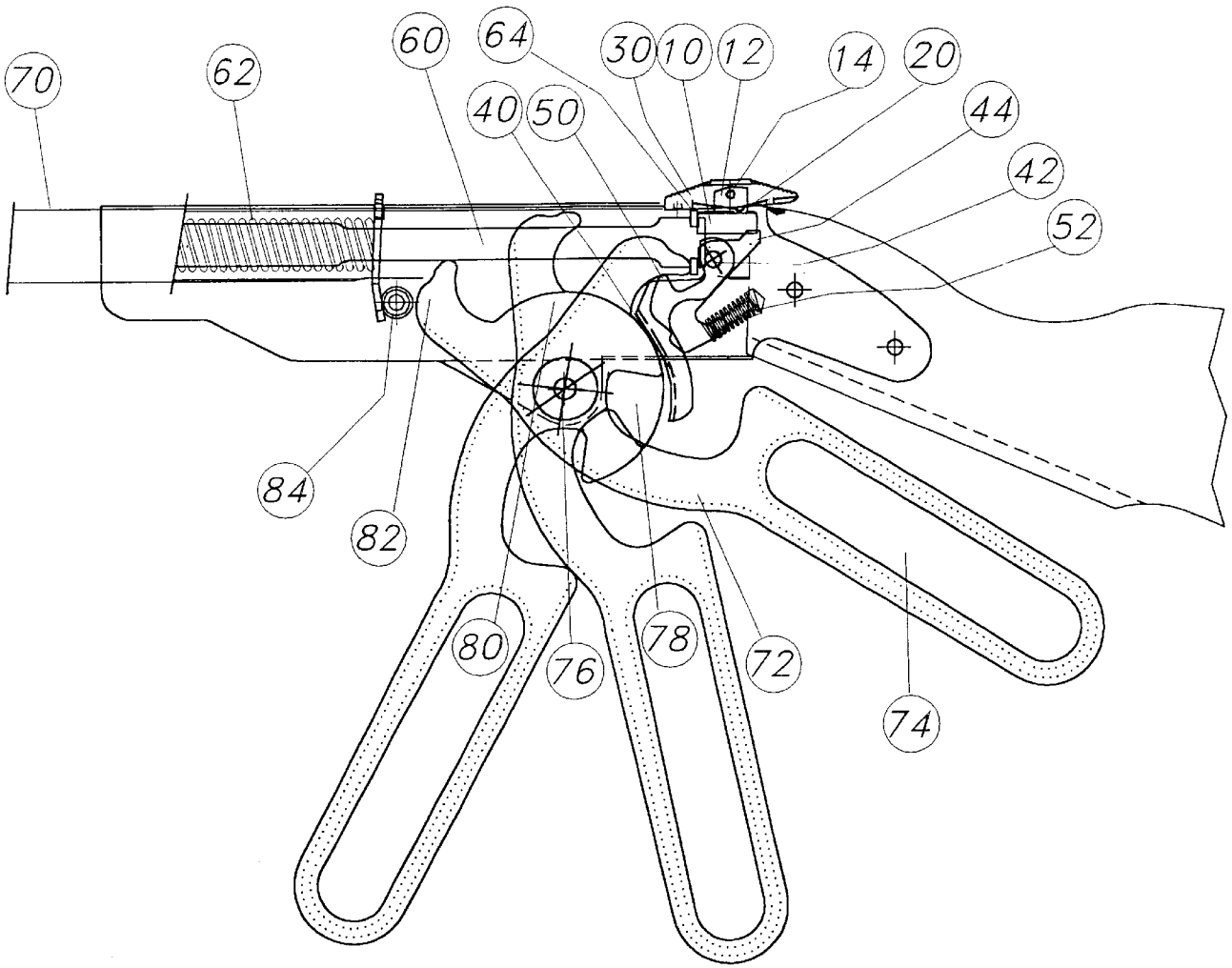

The loading action (FIG. 13) is completed when the, plate 64 hauled by the pusher 82 jumps over the retention plate 50 operating the spring 52 to then return locking the stem of the piston 60 as if it were a door lock. Likewise, the plate 64 will touch the base of the latch 10 making it move backwards and locking the safety 30 automatically. At the same time, the hook of the pusher 82 slightly moves the trigger 40, and thus the elongated portion that forms the support legs of the safety 44 will be placed under the base of the latch 10 not allowing the trigger to operate and thus not firing the gun.

Figure 14:
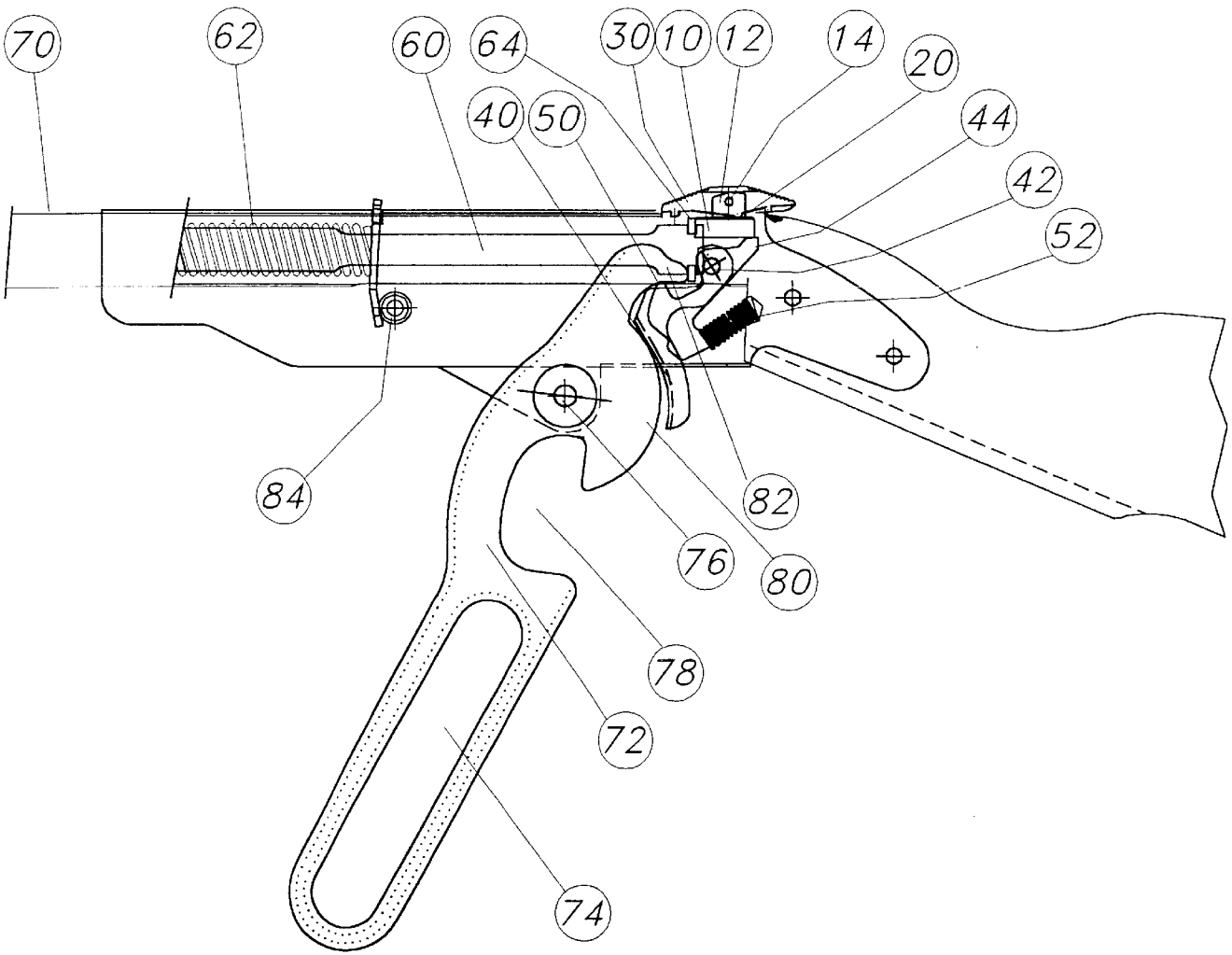

The operation is concluded (FIG. 14) when the loading cam 72 is returned to its original position in which the piston spring 62 remains pressed and the piston 60 is slightly displaced forwards.

Figure 15:
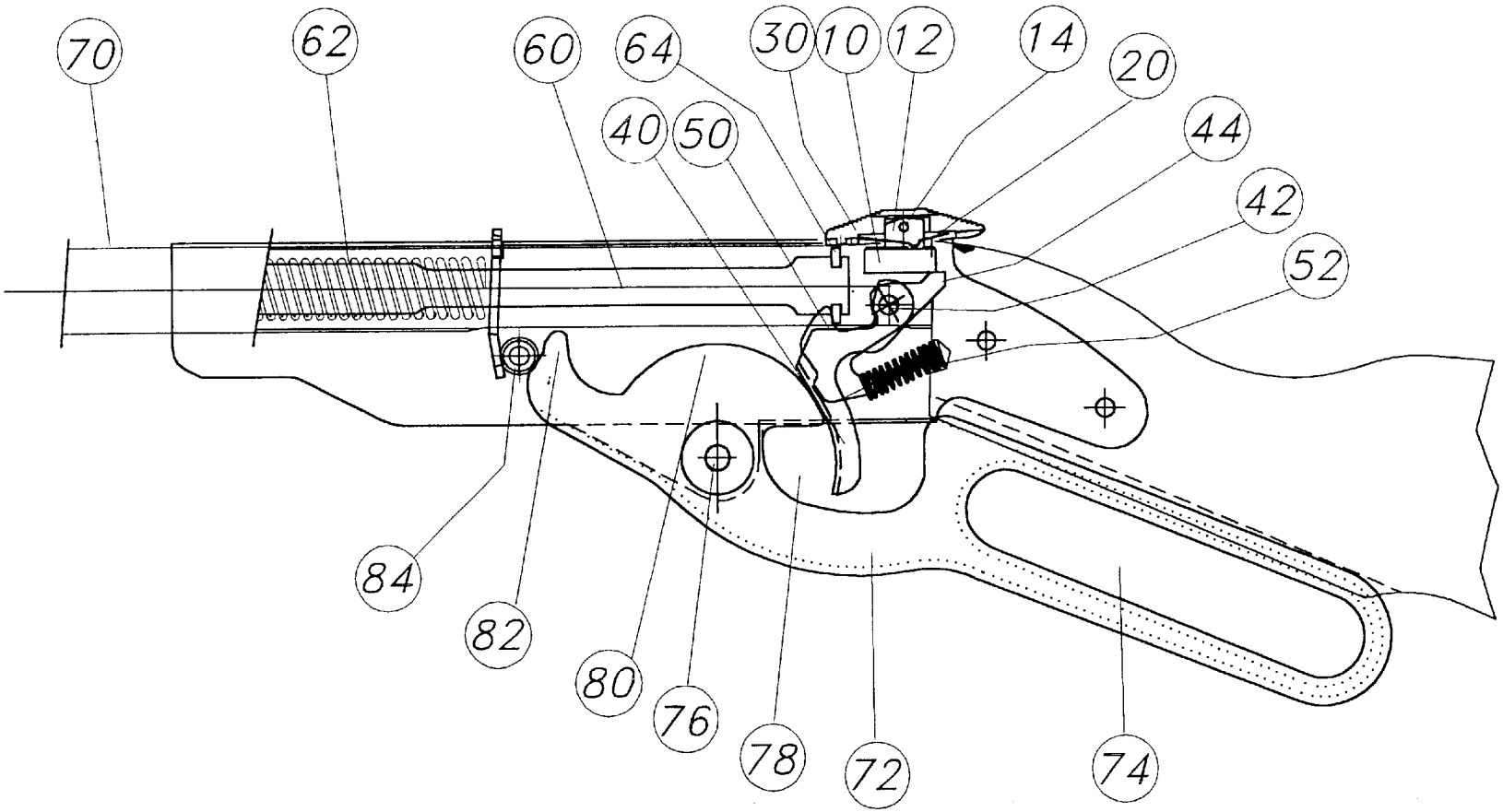
FIG. 15 is another cross-section view of the gun that shows the position of the locked safety when the gun is loaded and ready to shoot.

Once the loading cam 72 gets to its original position, the retaining cam of the crescent spring located towards the back of the pusher 82 is adjusted with the pawl 84 producing a sound that means that the loading cam 72 is ready to shoot (FIG. 15).

In order to shoot, it will be necessary to push the safety 30 towards the front, and thus the support legs of the latch 10 will be released.

Pushing the trigger 40, the piston will move forwards shooting a pellet, the spring of the piston 62 will uncoil again as shown on FIG. 11.

While the latch 10 is operated the gun will by no means fire even when the trigger 40 is pushed. The gun will not fire either when the loading preparation cam 72 is displaced from its original position even when loaded because the crescent piece 80 will be located in front of the trigger 40.

I claim:

1. A safety apparatus comprising:

a rifle having a barrel at a front thereof and a butt at a back thereof, and rifle having a firing mechanism box positioned between said barrel and said butt, said mechanism box having an eyelet formed on a top thereof;

an external safety positioned at a top of said mechanism box where said mechanism box joins said butt, said external safety being resiliently rockable, said safety having a square button with cut edges on a top thereof so as to have a trapezium cross-sectional shape, said safety having a grooves on a surface thereof, said safety having a slightly curved button conforming to a shape of said mechanism box, said safety having a vertical peg engageable within said eyelet of said mechanism box, said safety having a box area into which a spring is positioned, said spring resiliently urging said safety into a forward rocking position, said safety having a bore formed in a side thereof; and a latch positioned on said mechanism box and having a rectangular piece extending upwardly therefrom, said bore of said safety receiving said rectangular piece of said latch therein, said latch having a rectangular shaped section from which said rectangular piece extends, said rectangular piece having an oval base, said rectangular piece having a bore aligned with said bore of said safety, a pin extends through the bore so as to pivotally join said safety to said latch, said rectangular piece having a cut on a top surface thereof, said cut inclining a top surface forwardly, said rectangular piece extending through the eyelet of said mechanism box, said top of said safety being pushable at a rear end thereof so as to receive said peg from said eyelet of said mechanism box and to move said safety forwardly on said top of said mechanism box, said spring being a leaf spring having an oval central bore, said leaf spring being slightly bent on one end thereof so as to have a flexion movement to tilt said safety forwardly.

* * * * *